US010794144B2

(12) United States Patent
Stair et al.

(10) Patent No.: US 10,794,144 B2
(45) Date of Patent: Oct. 6, 2020

(54) DOWNHOLE TOOL WITH MAGNETIC BYPASS SEAT

(71) Applicant: Halliburton Energy Services, Inc., Houston, TX (US)

(72) Inventors: Todd Anthony Stair, Duncan, OK (US); Nicholas Frederick Budler, Marlow, OK (US); Patrick Lyle Cherney, Newton, KS (US)

(73) Assignee: Halliburton Energy Services, Inc., Houston, TX (US)

( * ) Notice: Subject to any disclaimer, the term of this patent is extended or adjusted under 35 U.S.C. 154(b) by 640 days.

(21) Appl. No.: 14/913,944

(22) PCT Filed: Sep. 11, 2013

(86) PCT No.: PCT/US2013/059240
§ 371 (c)(1),
(2) Date: Feb. 23, 2016

(87) PCT Pub. No.: WO2015/038115
PCT Pub. Date: Mar. 19, 2015

(65) Prior Publication Data

US 2016/0222760 A1 Aug. 4, 2016

(51) Int. Cl.

| | |
|---|---|
| ***E21B 33/129*** | (2006.01) |
| ***E21B 34/06*** | (2006.01) |
| ***E21B 34/10*** | (2006.01) |
| ***E21B 33/134*** | (2006.01) |
| ***E21B 34/08*** | (2006.01) |

(52) U.S. Cl.
CPC ..... *E21B 34/10* (2013.01); *E21B 33/1294* (2013.01); *E21B 33/134* (2013.01); *E21B 34/08* (2013.01); *E21B 2200/04* (2020.05)

(58) Field of Classification Search
CPC .... E21B 34/14; E21B 2034/002; E21B 34/10; E21B 33/1294; E21B 34/08; E21B 2200/04; F16K 31/08; F16K 17/28
USPC ..... 137/511–543.23; 251/65
See application file for complete search history.

(56) References Cited

U.S. PATENT DOCUMENTS 3,468,338 A * 9/1969 Patterson ..... F16K 15/04 137/517
4,212,313 A * 7/1980 Winters ..... F16K 17/366 137/39
4,560,168 A 12/1985 Aoyama
(Continued)

FOREIGN PATENT DOCUMENTS

CN 2816352 9/2006

OTHER PUBLICATIONS

CA 2,917,873, Halliburton Energy Services, Inc., Canadian Examination Search Report dated Nov. 29, 2016.
(Continued)

*Primary Examiner* — Waseem Moorad
*Assistant Examiner* — Lamia Quaim
(74) *Attorney, Agent, or Firm* — McAfee & Taft

(57) ABSTRACT

A check valve is provided having a magnetic plug and a magnetic seat. The magnetic seat and magnetic plug operationally engage so as to have a magnetic resistivity such that there is a first position in which the magnetic plug does not sealingly engage the magnetic seat and a second position where the magnetic plug is sealingly engaged with the magnetic seat.

17 Claims, 10 Drawing Sheets

(56) References Cited

U.S. PATENT DOCUMENTS

| | | | | |
|---|---|---|---|---|
| 5,280,806 | A * | 1/1994 | Glazebrook | F16K 17/285 137/517 |
| 5,984,007 | A | 11/1999 | Yuan et al. | |
| 6,087,915 | A * | 7/2000 | Leupold | H01F 13/003 335/284 |
| 6,200,232 | B1 * | 3/2001 | Kasashima | A63B 37/0004 473/379 |
| 6,220,360 | B1 | 4/2001 | Connell et al. | |
| 6,491,116 | B2 * | 12/2002 | Berscheidt | E21B 33/12 166/243 |
| 2006/0157240 | A1 | 7/2006 | Shaw et al. | |
| 2009/0071654 | A1 | 3/2009 | O'Malley et al. | |
| 2010/0294502 | A1 * | 11/2010 | Xu | E21B 34/10 166/332.8 |
| 2011/0259610 | A1 | 10/2011 | Shkurti et al. | |
| 2012/0118582 | A1 | 5/2012 | Soni et al. | |
| 2013/0046290 | A1 | 2/2013 | Howell et al. | |
| 2013/0264051 | A1 * | 10/2013 | Kyle | E21B 41/00 166/244.1 |

OTHER PUBLICATIONS

International Search Report and Written Opinion dated Jun. 9, 2014 in corresponding PCT application No. PCT/US2013/059240, Halliburton Energy Services, Inc.

PCT/US2013/059240, Halliburton Energy Services, Inc. International Search Report dated Jun. 9, 2014.

Second Written Opinion dated Jan. 18, 2018, in corresponding Singapore Patent Application No. 11201601008R.

* cited by examiner

DOWNHOLE TOOL WITH MAGNETIC BYPASS SEAT

FIELD OF THE INVENTION

This invention relates generally to check valves and plug tools. This invention particularly relates to check valves and plug tools and apparatuses for use in oil and gas wellbores and methods for using the same.

BACKGROUND OF THE INVENTION

In the drilling and completion of oil and gas wells, a wellbore is drilled into the subterranean producing formation or zone of interest. A string of pipe, e.g., casing, is typically then cemented into the wellbore. Oftentimes, a second string of pipe, commonly referred to as a liner, is attached at the lower end of the casing and extends further into the wellbore. Casing, when referred to herein, includes liners. A string of additional pipe, known as production tubing, is often lowered into the casing and/or the liner for conducting produced fluids out of the wellbore.

Downhole tools are used during various well operations; such as float collars during cementing operations and such as packers, frac plugs or other tools during casing or production operations. Many known downhole tools require a ball to be displaced down a tool string to engage a ball seat disposed in the tool. Typically, pressure is applied after the ball engages the seat to activate a mechanism in the tool.

Such downhole tools often include a mandrel having an axial bore therethrough and a plug seat or ball seat disposed within the bore. The seat is configured to receive a ball or plug to prevent flow through the axial bore and, for example, isolate zones of a wellbore. The ball is seated in the seat when a pressure differential is applied across the seat from above. For example, as fluids are pumped from the surface downhole, the ball is seated in the seat by the fluid flow and the pressure differential across the seated ball maintains it in the seat; thus, closing off the axial bore in the mandrel. In other words, the seated ball may prevent fluid above the ball from flowing to portions of the wellbore below the ball.

In many instances, a caged ball is utilized to run the ball down hole within the downhole tool and enable plugging when desired by developing fluid pressure behind the ball so as to seal it against the seat. In some cases, it is desirable to allow fluid to be pumped from the surface downhole below the ball. In the past, downhole tools have relied on the use of springs to hold the ball off seat or utilized bypass through restricted ports to circumvent the ball once it was seated.

It is of interest in drilling and completion operations to have alternative means of achieving bypass flow, which do not rely on springs or bypass ports.

BRIEF DESCRIPTION OF THE DRAWINGS

FIG. 6 is an enlarged cross-sectional view of the plug section of the embodiment of FIG. 4. The plug section is shown in the closed position and the plug is shown in cross-section.

FIG. 9 is a schematic view of a plug illustrating an example of a pattern for the magnetic inserts with truncated icosahedral symmetry or a soccer ball pattern for icosahedral symmetry.

DETAILED DESCRIPTION OF THE INVENTION

Figure 1:
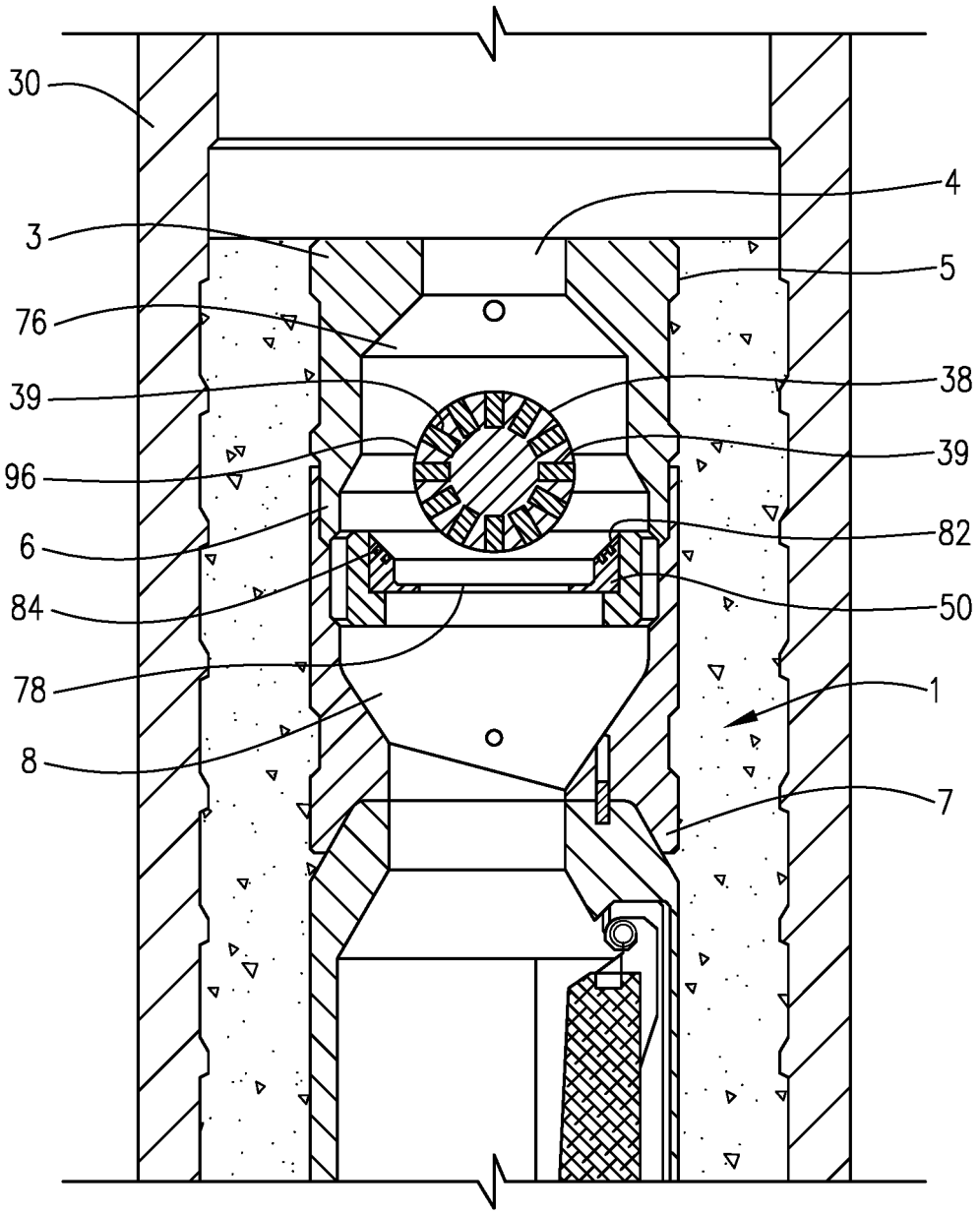
FIG. 1 is a schematic view of a portion of a downhole tool utilizing a plug in accordance with an embodiment.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail.

Referring now to the drawings, and more specifically to FIG. 1, a check valve or flow restricting check valve comprising a plug 38 and corresponding plug seat 50 in accordance with one embodiment is illustrated. Plug 38 and plug seat 50 are shown in a portion of a downhole tool 1. The portion 1 illustrated is an auto-fill float collar of the type that might be used in well cementing operations. Plug 38 is located within a chamber 76, which is defined by a housing 3. Housing 3 further defines a first aperture 4 at a first or upper end 5. Housing 3 has plug seat 50 at a second or lower end 6. Plug seat 50 defines a second aperture 78. Additionally, a mandrel 7 having a central bore 8 can be in fluid flow communication with chamber 76 through second aperture 78. The portion 1 is shown in FIG. 1 as located in a well. The well comprises a wellbore having a casing 30 set therein.

Plug 38 is a sealing plug in that it can seal against plug seat 50 to prevent fluid flow through aperture 78. Plug 38 is generally in the form of a ball or sphere and, thus, may be sometimes referred to herein as ball 38; however, it should be understood that other shapes can be used, such as a truncated cone with chamber 76 having a suitable shape cage to prevent longitudinal rotation.

Plug 38 is a magnetic plug having generally the same magnetic polarity across its surface. As illustrated, the magnetic polarity is produced by plug 38 having a plurality of magnetic inserts 39. Plug seat 50 is a magnetic seat having generally the same magnetic polarity across its upper surface 82. As illustrated, the magnetic polarity is produced by plug seat 50 having a plurality of magnetic inserts 84. Plug 38 and seat 50 are matching in that plug 38 can sealingly engage plug seat 50 so as to prevent fluid flow through aperture 78 and in that plug 38 and seat 50 have the same magnetic polarity; that is, the outer surface 96 of plug 38 and upper surface 82 of seat 50 either both have a magnetic polarity of north or both have magnetic polarity of south; although, the magnetic intensity can be different. Accordingly, there will be a magnetic resistivity between plug 38 and plug seat 50, by which it is meant that there will be a magnetic repulsion between plug 38 and plug seat 50. Accordingly, plug 38 will not sealingly engage plug seat 50 until this magnetic resistivity is overcome by a predetermined amount of force or pressure on plug 38. Generally, this can be provided from a flow of fluid passing down through chamber 76. That is, as fluid flows in through first aperture 4, through chamber 76 and out through second aperture 78, it will produce a drag force or pressure acting on plug 38. This drag force will be towards plug seat 50; however, this drag force will be countered by the magnetic resistivity, which is pushing plug 38 away from plug seat 50. As the fluid flow rate is increased, the drag force will increase, which will move plug 38 closer to plug seat 50 and thereby increase the magnetic resistivity until it again balances the drag force. With continued increase in fluid flow rate, the drag force will continue to increase until it equals the magnetic resistivity when plug 38 is sealed against plug seat 50. The amount of drag force or fluid pressure needed to seal plug 38 can be predetermined so that plug 38 will seal against seat 50 at a desired fluid pressure. As long as this predetermined fluid pressure or greater is maintained, plug 38 will remain sealed against plug seat 50. Thus, it can be understood that plug 38 and seat 50 form a check valve or, more precisely, a flow restricting check valve where flow is allowed in the checked direction until a predetermined fluid flow rate or fluid pressure is reached.

Plug 38 can be made of any suitable material. Where the downhole tool is to be removed from the wellbore by drilling after use, the material can be chosen from ones that are easily drilled out. Suitable materials include, but are not limited to, fiber resin composites such as carbon fiber, phenolic plastic, fiberglass, aluminum, and brass. Generally, magnetic material such as iron and steel should be avoided for use as plug 38 in that they can interfere with establishing a uniform magnetic field across surface 96 of plug 38. Magnetic inserts 39 can be ferromagnetic magnets or similar. Magnetic inserts 39 can be any suitable shape but, typically, will be discs or cylinders. Magnetic inserts 39 can have an outer surface 94 (see FIGS. 5 and 6) flush with the outer surface 96 of plug 38 or can be located under outer surface 96 so that outer surface 94 of magnetic insert 39 is covered by outer surface 96. In the latter case, it is preferred that magnetic inserts 39 are close enough to the surface so as to provide an adequate magnetic field to interact with plug seat 50. Magnetic inserts 39 can be symmetrically spaced about plug 38 so as to produce a generally uniform magnetic field.

Similarly, plug seat 50 can be made of any suitable material. Where the downhole tool is to be removed from the wellbore by drilling after use, the material can be chosen from ones that are easily drilled out. Suitable materials include, but are not limited to, fiber resin composites such as carbon fiber, phenolic plastic, fiberglass, aluminum, and brass. Generally, magnetic material such as iron and steel should be avoided for use as plug seat 50 in that they can interfere with establishing a uniform magnetic field across surface 82 of plug seat 50. Magnetic inserts 84 can be ferromagnetic magnets or similar. Magnetic inserts 84 can be any suitable shape but, typically, will be discs or cylinders. Magnetic inserts 84 can have an outer surface 86 (see FIGS. 5 and 6) flush with the upper surface 82 of plug seat 50 or can be located under upper surface 82 so that outer surface 86 of magnetic insert 84 is covered by upper surface 82. In the latter case, it is preferred that magnetic inserts 39 are close enough to the surface so as to provide an adequate magnetic field to interact with plug seat 50. Magnetic inserts 84 can be symmetrically spaced about plug seat 50 so as to produce a generally uniform magnetic field.

Figure 7:
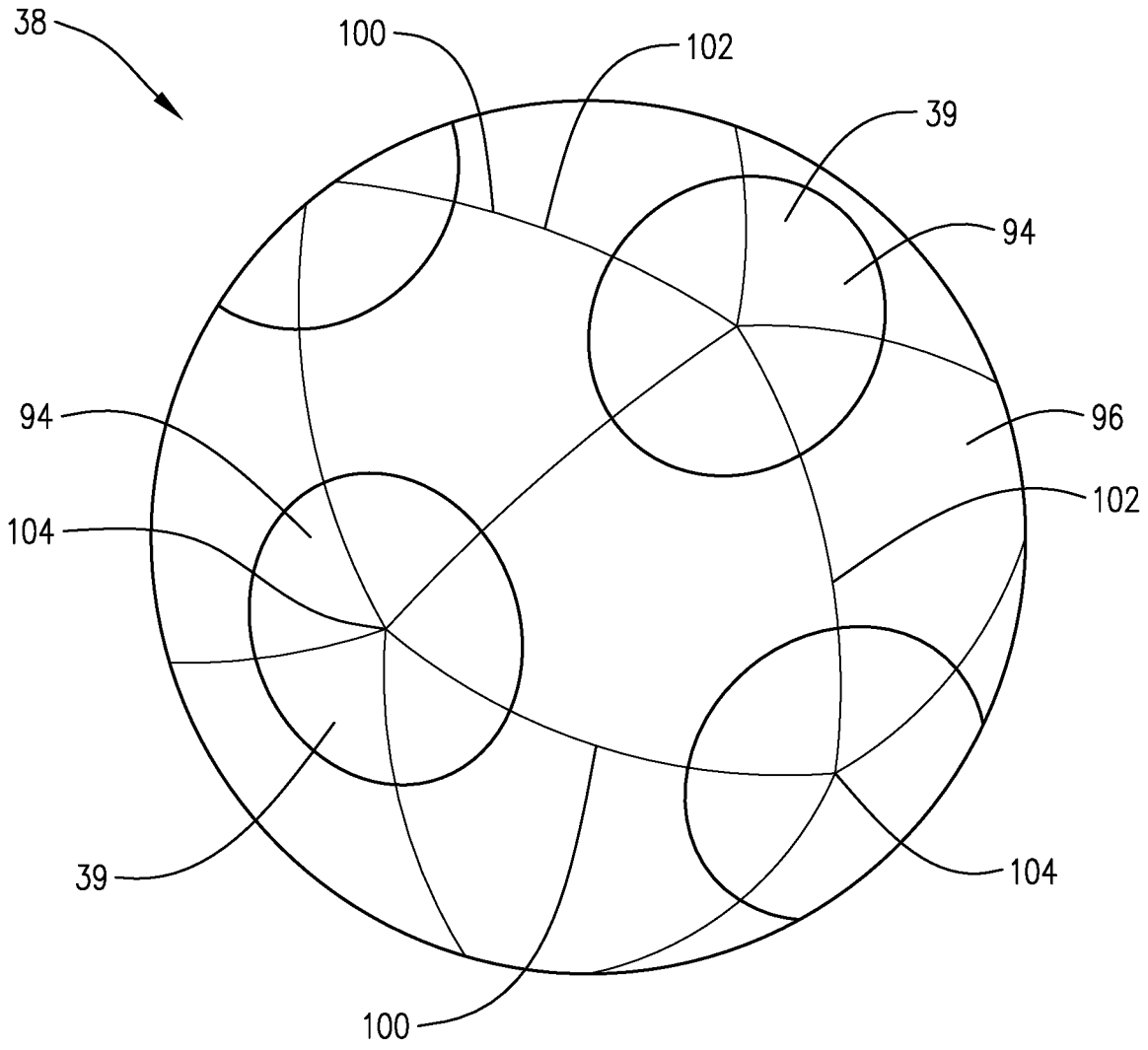
FIG. 7 is a schematic view of a plug illustrating one example of a pattern for the magnetic inserts with icosahedral symmetry.
Figure 8:
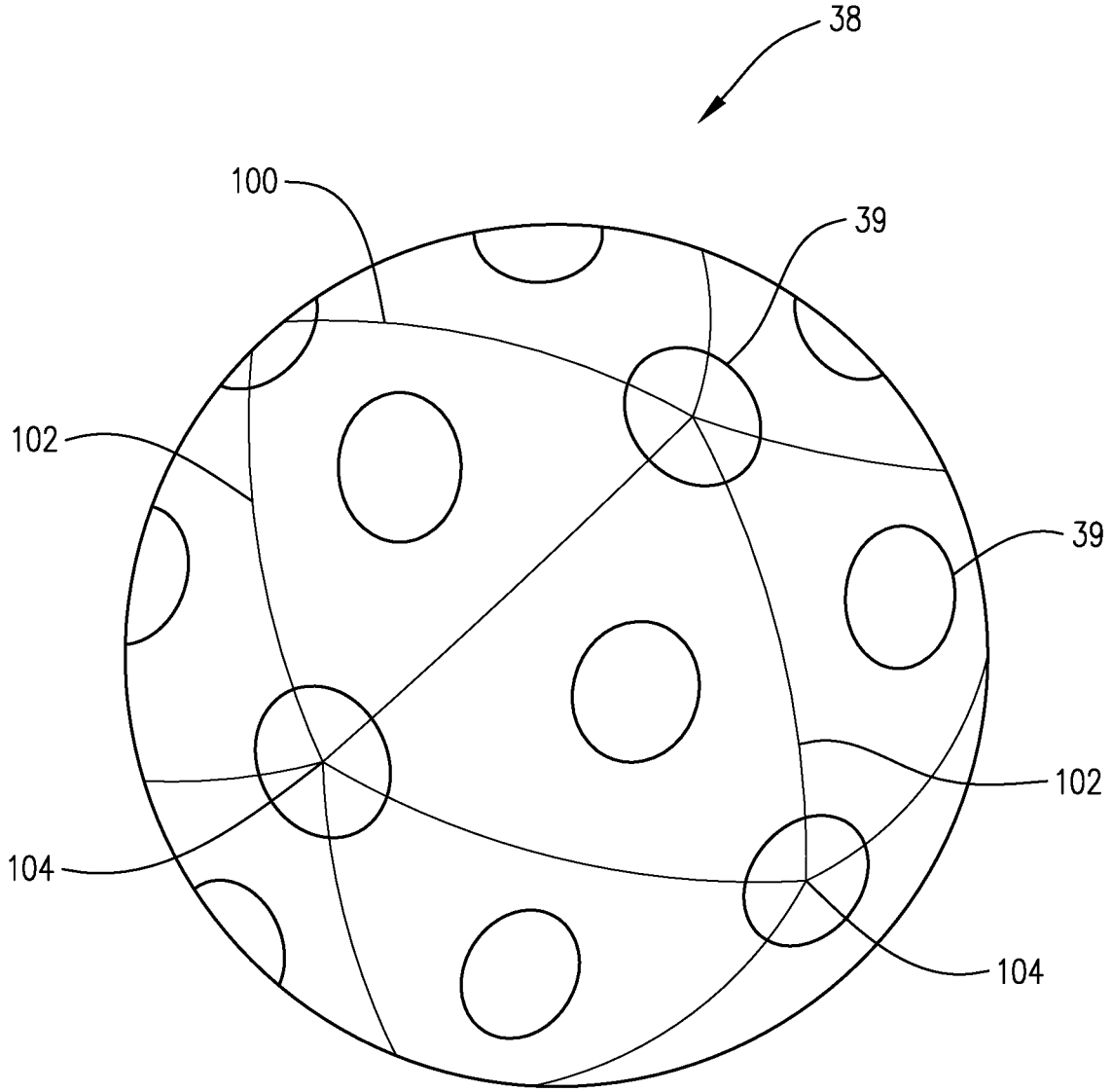
FIG. 8 is a schematic view of a plug illustrating another example of a pattern for the magnetic inserts with icosahedral symmetry.
Figure 8:
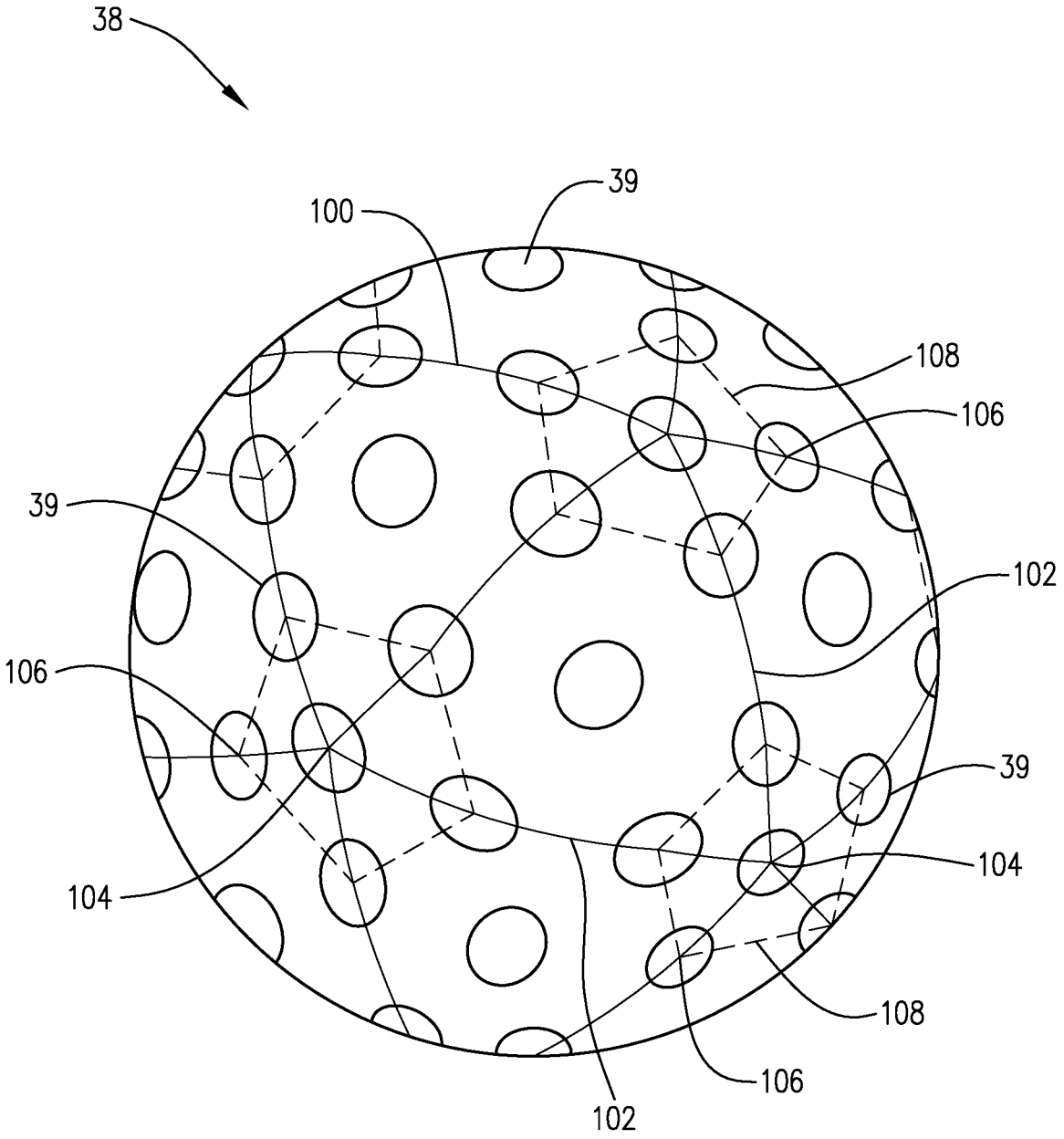

Turning now to FIGS. 7 to 9, suitable arrangements of magnetic inserts 39 in plug 38 will be discussed. Plug 38 is subject to rotation within chamber 76, especially before it has sealingly engaged plug seat 50. Thus, it has been found that the magnetic field around plug 38 needs to have a generally uniform magnetic field in order to have a generally uniform magnetic resistivity with plug seat 50 for different orientations of plug 38 with respect to plug seat 50. It has been found that low symmetrical arrangements (one axis of symmetry or less) of inserts 39 in plug 38 can result in substantial fluctuations of magnetic resistivity between plug 38 and plug seat 50 for different orientations of plug 38 and, in some cases, can result in a magnetic attraction between plug 38 and plug seat 50 for certain orientations. Accordingly, in an embodiment the arrangement of magnetic inserts 39 in plug 38 has more than one axis of symmetry. In another embodiment, the arrangement of magnetic inserts 39 in plug 38 has six axes of symmetry.

FIG. 7 illustrates a plug 38 with an arrangement of magnetic inserts 39 having six axes of symmetry. The arrangement of FIG. 7 is based on the concept of a spherical icosahedron where a spherical surface is divided into equilateral triangular segments. The solid lines 100 form the twenty icosahedral spherical triangles 102 which correspond to the faces of a regular icosahedron. (The solid lines 100 are imaginary of course and do not appear on the actual plug. The lines are shown in the drawing in order to facilitate visualization of the icosahedral triangles.) Magnetic inserts 39 are centered on the vertexes 104 of icosahedral spherical triangles 102 such that there are 12 magnetic inserts and six axes of symmetry for the arrangement of this embodiment.

FIG. 8 illustrates another plug 38 with an arrangement of magnetic inserts 39 having six axes of symmetry. The arrangement illustrated in FIG. 8 is similar to that of FIG. 7, except that there are magnetic inserts centered in each icosahedral spherical triangle 102 and centered on each vertex 104. Thus, the arrangement of this embodiment has 32 magnetic inserts.

FIG. 9 illustrates yet another plug 38 with an arrangement of magnetic inserts 39 having six axes of symmetry. This arrangement is referred to as a soccer ball pattern in that it is a truncated icosahedral pattern. The soccer ball pattern of FIG. 9 has magnetic inserts centered at the vertexes 106 of a pentagon around each icosahedral triangle vertex 104. The pentagons are shown by dotted lines 108. (The dotted lines 108, like solid lines 100, are imaginary and do not appear on the actual plug but are shown in the drawing in order to facilitate visualization of the pentagons.) Additionally, plug 38 has magnetic inserts centered at vertexes 104 and in each icosahedral spherical triangle 102. Thus, the soccer ball pattern of this embodiment further divides each icosahedral spherical triangle into nine smaller equilateral triangles with the magnets centered on the vertexes of the smaller triangles. The soccer ball pattern of this embodiment has 92 magnetic inserts.

Figure 10:
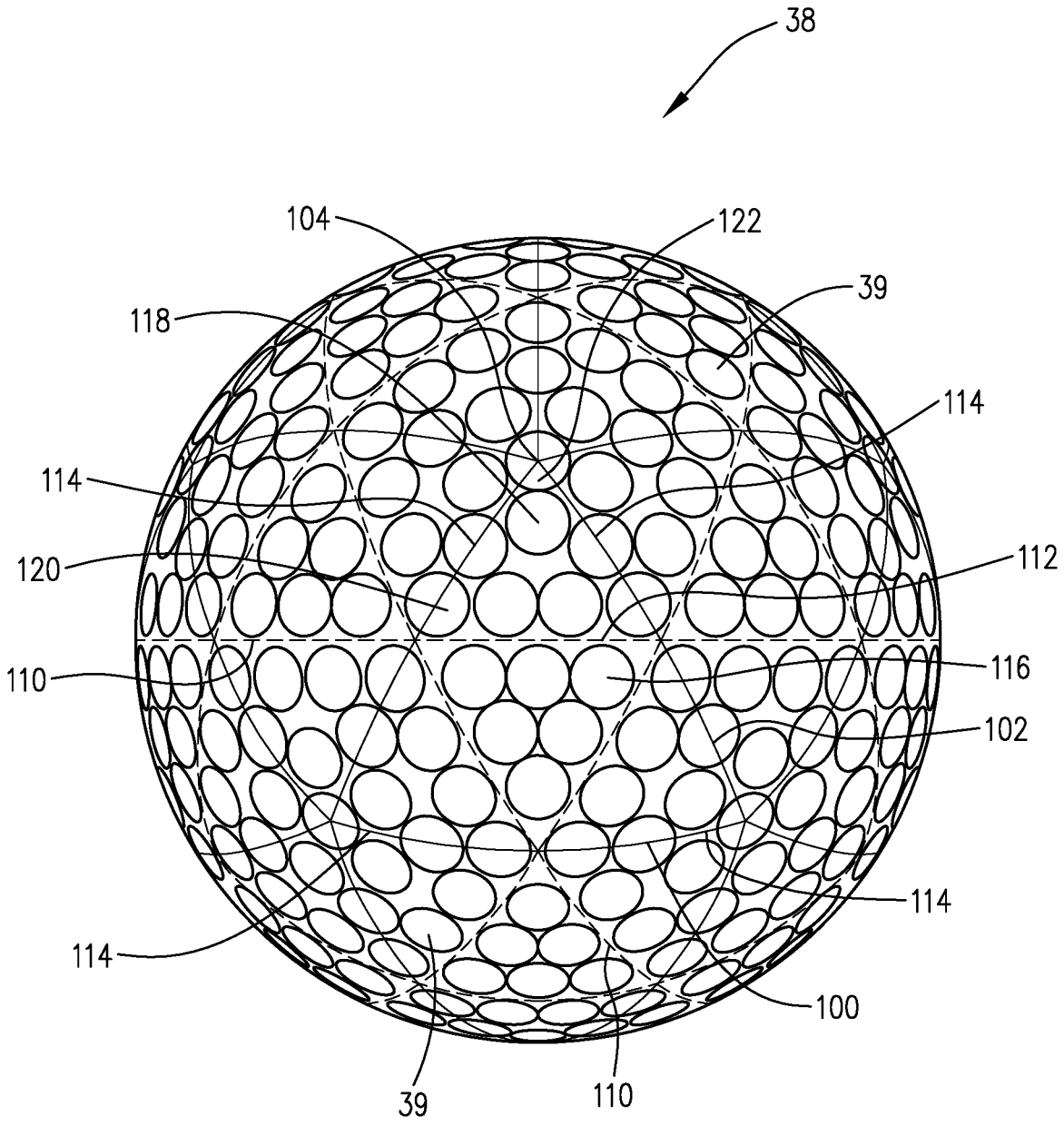
FIG. 10 is a schematic view of a plug illustrating an example of a pattern for the magnetic inserts having a golf ball type icosahedral symmetry.

FIG. 10 illustrates yet another plug 38 with an arrangement of magnetic inserts 39 having six axes of symmetry. This arrangement is referred to as a golf ball pattern in that it utilizes a pattern that results in multiple magnetic inserts 39 within each icosahedral spherical triangle 102 and multiple magnetic inserts on icosahedral triangle lines 100. Moreover, the golf ball pattern further divides each icosahedral spherical triangle 102 into four smaller triangles with each having one or more magnetic inserts therein. To further explain, the solid lines 100 form the twenty icosahedral spherical triangles 102 which correspond to the faces of a regular icosahedron, and the six dotted lines 110 are great circle paths. In FIG. 10 the great circle path 110 is the equator of the ball. Since the icosahedral triangles 102 are identical, any of the apexes or vertexes 104 where five icosahedral triangles meet can be considered a pole of plug 38, and any of the great circle paths 110 can be considered the equator of plug 38. Plug 38 therefore has six axes of symmetry, which extend perpendicularly to the six equatorial planes and through the six opposed pairs of poles.

The solid lines 100 and dotted lines 110 are imaginary, of course, and do not appear on the actual plug. The lines are shown in the drawing in order to facilitate visualization of the icosahedral triangles, the great circle paths which intersect the sides of the icosahedral triangles, and the way in which the magnetic inserts 39 are arranged in the four smaller triangles.

In FIG. 10 the three sides of each icosahedral triangle 102 are connected at their midpoints by three great circle paths 110 to form a central triangle 112 and three apical triangles 114. In the golf ball pattern illustrated in FIG. 10, each central triangle 112 encloses six magnetic inserts 116, and each apical triangle encloses three whole magnetic inserts 118, four half magnetic inserts 120 and one one-fifth magnetic insert 122, which is located at the vertex of the icosahedral spherical triangles. The illustrated plug has a total of 432 magnetic inserts.

The above illustrated magnetic insert arrangements are exemplary and there are other arrangements that retain six axes symmetry that will become apparent to those skilled in the art, such as using different size inserts in the golf ball pattern so that more or less insets are used.

Figure 2:
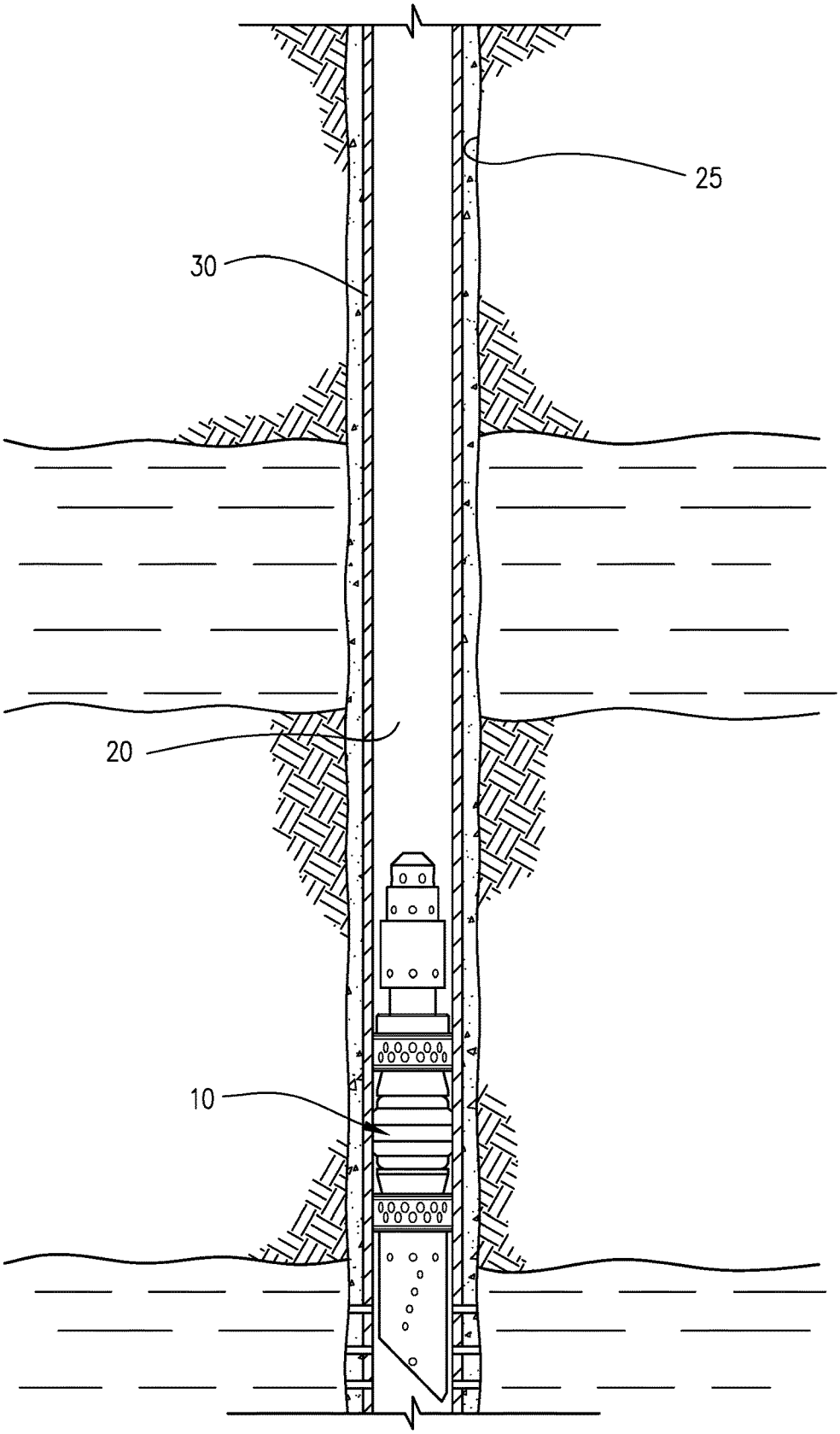
FIG. 2 is a schematic view of another downhole tool positioned in a wellbore.

Turning now to FIGS. 2 to 6, a downhole tool 10 illustrates a further embodiment. The illustrated downhole tool 10 is a frac plug; however, the uses of the system described herein will become apparent to those skilled in the art based on this disclosure. The downhole tool 10 is schematically shown in FIG. 2 in the set position. The downhole tool 10 shown in FIG. 2 is shown after having been lowered into a well 20 with a setting tool of any type known in the art. Well 20 comprises a wellbore 25 having a casing 30 set therein.

Figure 3:
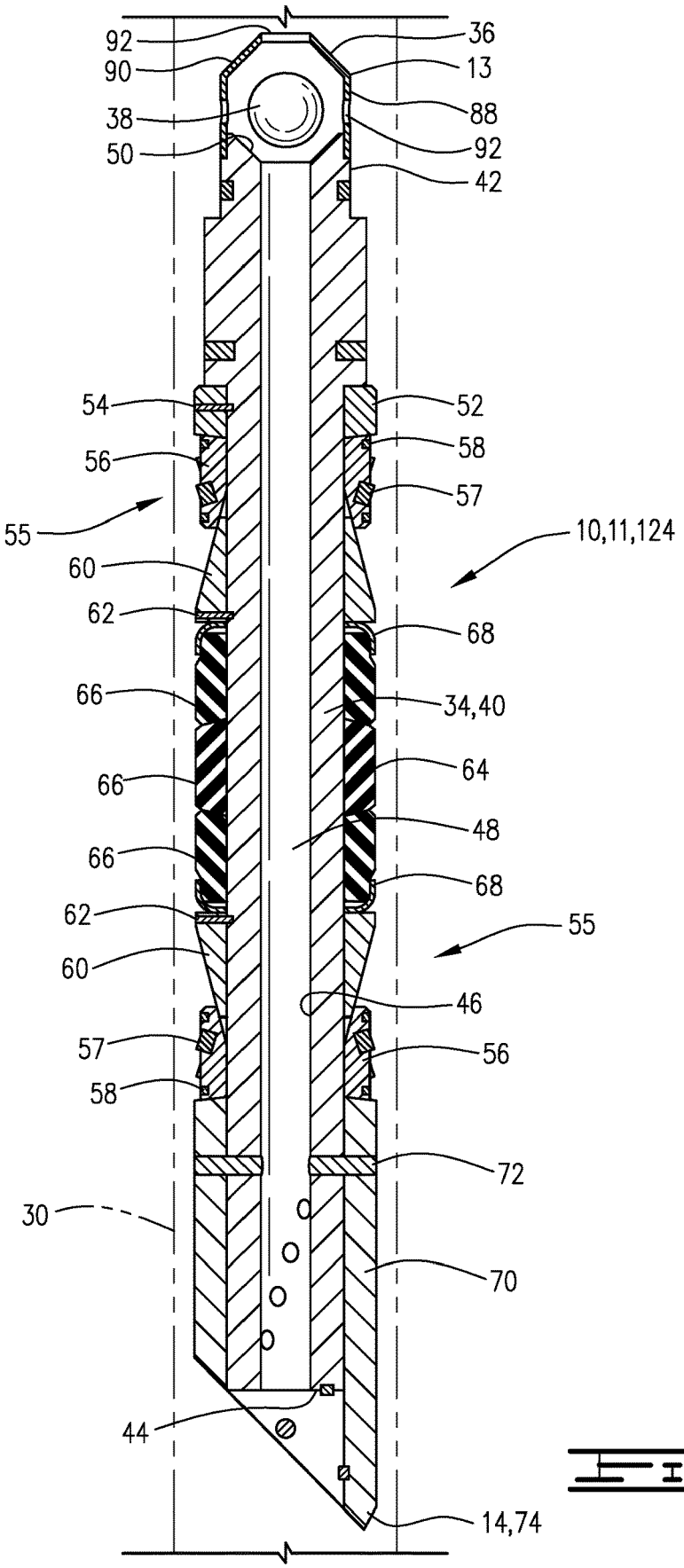
FIG. 3 is a cross-sectional view of the downhole tool of FIG. 2. The downhole tool is illustrated in the unset position with the plug in the open position.
Figure 4:
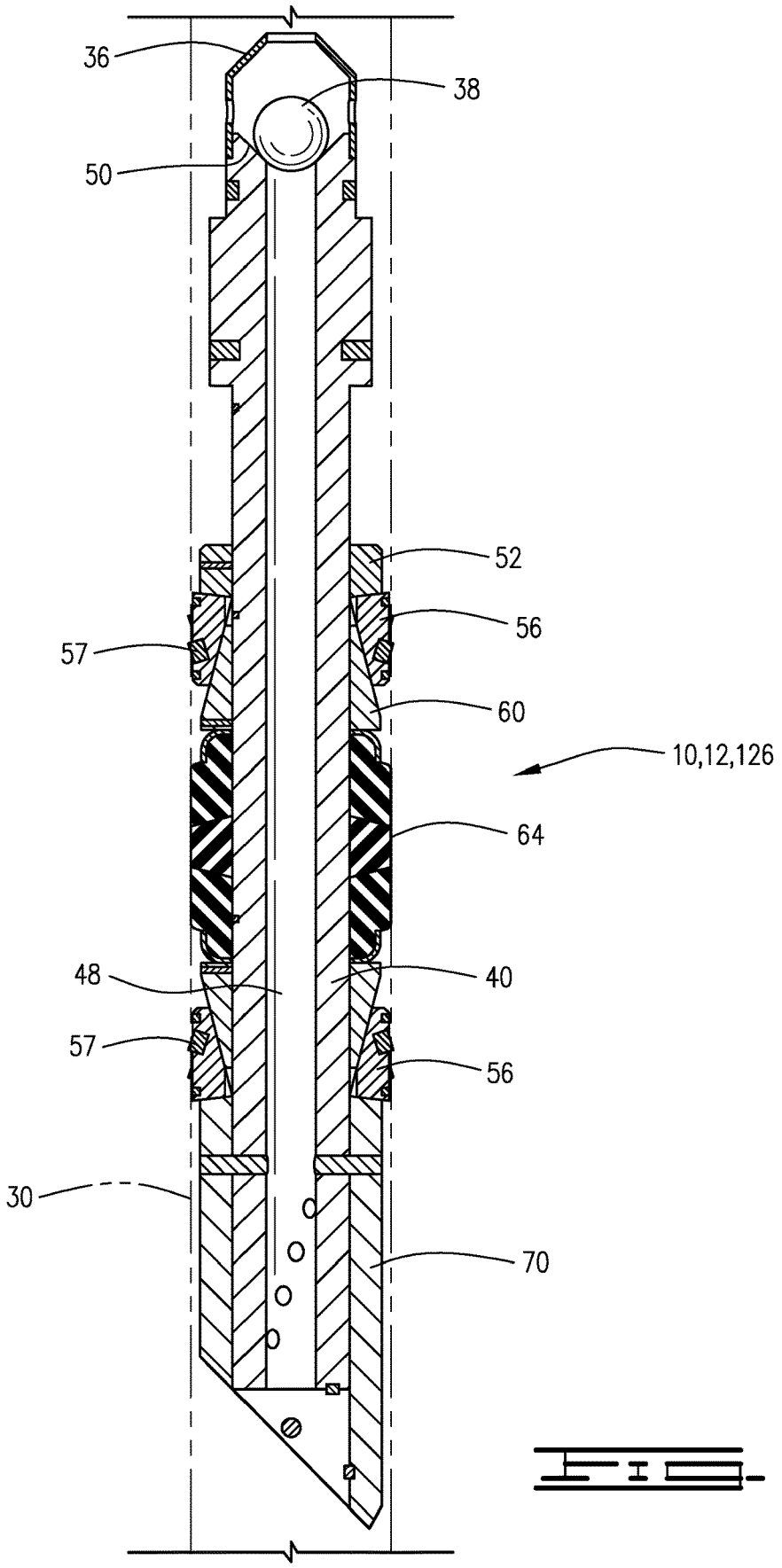
FIG. 4 is a cross-sectional view of the downhole tool of FIG. 2 illustrated in the set position with the plug in the open position.

Referring now to FIGS. 3 and 4, a cross-section of the downhole tool 10 is shown in an unset position 11 (FIG. 3) and in a set position 12 (FIG. 4). Downhole tool 10 has an upper end 13 and a lower end 14. The downhole tool shown in FIGS. 2 to 6 is referred to as a frac plug since it will be utilized to seal the wellbore to prevent flow past the frac plug. The frac plug disposed herein may be deployed in wellbores having casings or other such annular structure or geometry in which the tool may be set. As is apparent, the overall downhole tool structure is like that typically referred to as a packer, which typically has at least one means for allowing fluid communication through the tool. Downhole tool 10 thus may be said to comprise a packer 34 having a cage or ball cap 36 extending from the upper end thereof. A plug 38 is disposed or housed in cage 36. Plug 38 is generally in the form of a ball or sphere and, thus, may be sometimes referred to herein as sealing ball 38; however, it should be understood that other shapes can be used, such as a truncated cone with a suitable cage to prevent longitudinal rotation. Packer 34 comprises a mandrel 40 having an upper end 42, a lower end 44, and an inner surface 46 defining a longitudinal central flow passage 48. Mandrel 40 defines a plug seat 50. As shown, plug seat 50 is defined at the upper end 42 of mandrel 40.

Packer 34 includes spacer ring 52 secured to mandrel 40 with pin 54. Spacer ring 52 provides an abutment which serves to axially retain slip segments 56 which are positioned circumferentially about mandrel 40. Packer 34 includes anchoring assembly 55 disposed about mandrel 40. As illustrated, anchoring assembly 55 comprises slip segments 56 and slip wedge 60. Slip segments 56 may utilize buttons 57 or circumferentially extending wickers on their outer surface to engage casing 30 in set position 12 and, thus, anchor downhole tool 10. Buttons 57 can be ceramic buttons as described in detail in U.S. Pat. No. 5,984,007. Slip retaining bands 58 serve to radially retain slip segments 56 in an initial circumferential position about mandrel 40 as well as slip wedge 60. Bands 58 are made of a steel wire, a plastic material, or a composite material having the requisite characteristics of having sufficient strength to hold the slip segments 56 in place prior to actually setting the downhole tool 10 and to be easily drillable when the downhole tool 10 is to be removed from the wellbore 25. Preferably, bands 58 are inexpensive and easily installed about slip segments 56. Slip wedge 60 is initially positioned in a slidable relationship to, and partially underneath slip segment 56. Slip wedge 60 is shown pinned into place by pins 62. Located below upper slip wedge 60 is at least one packer element, and as shown in FIG. 2, a packer element assembly 64 consists of three expandable packer elements 66 disposed about packer mandrel 40. Packer shoes 68 are disposed at the upper and lower ends of packer element assembly 64 and provide axial support thereto. The particular packer seal or element arrangement shown in FIG. 2 is merely representative as there are several packer element arrangements known and used within the art.

Located below lower slip wedge 60 is a plurality of slip segments 56. Below these lower slip segments 56, a mule shoe 70 is secured to mandrel 40 by radially oriented pins 72. Mule shoe 70 extends below the lower end 44 of packer 40 and has a lower end 74, which comprises lower end 14 of downhole tool 10. The lower most portion of downhole tool 10 need not be a mule shoe 70 but could be any type of section which serves to terminate the structure of downhole tool 10 or serves to be a connector for connecting downhole tool 10 with other tools, a valve, tubing or other downhole equipment.

Figure 5:
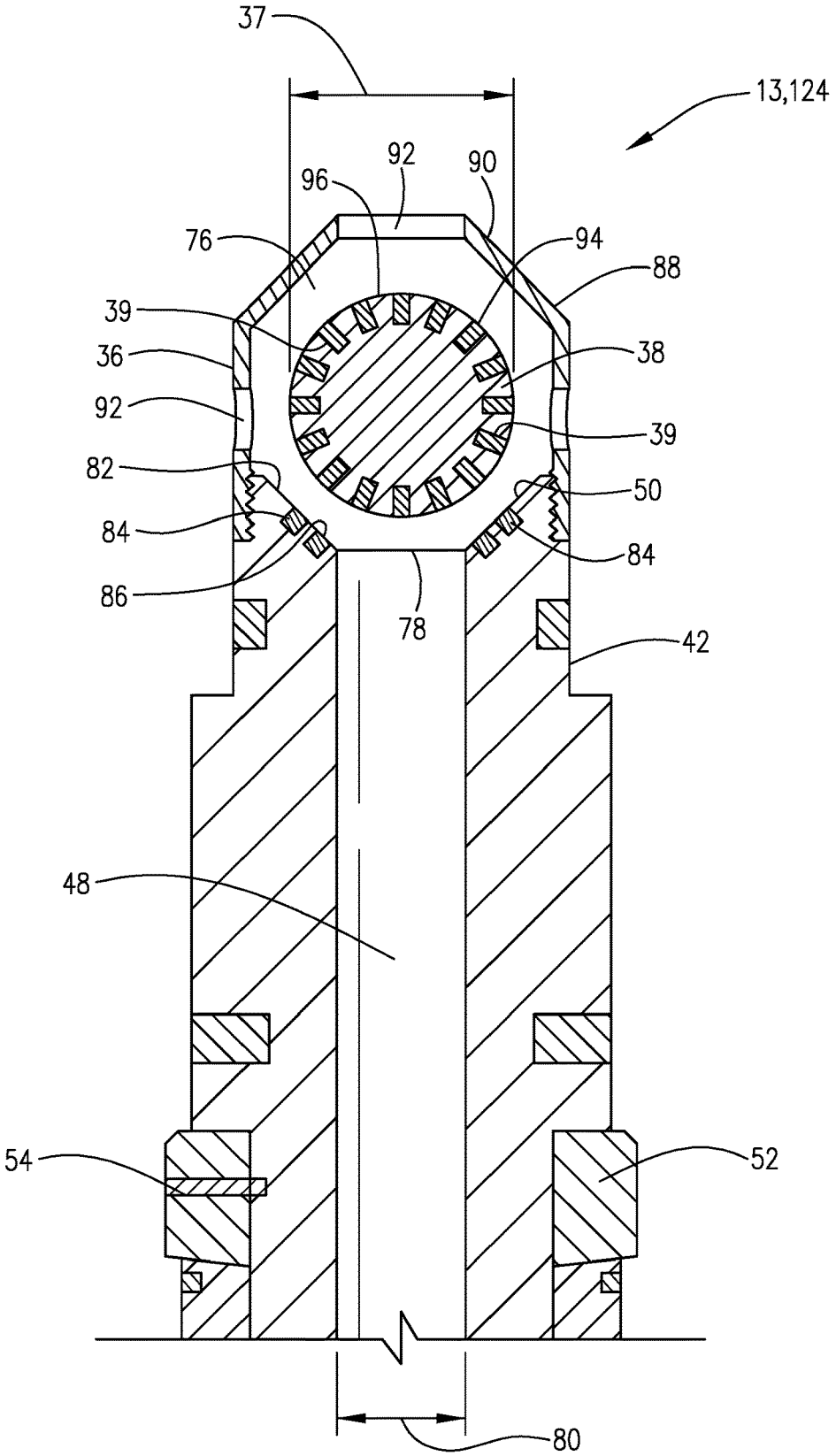
FIG. 5 is an enlarged cross-sectional view of the plug section of the embodiment of FIG. 3. The plug section is shown in the open position and the plug is shown in cross-section.
Figure 5:
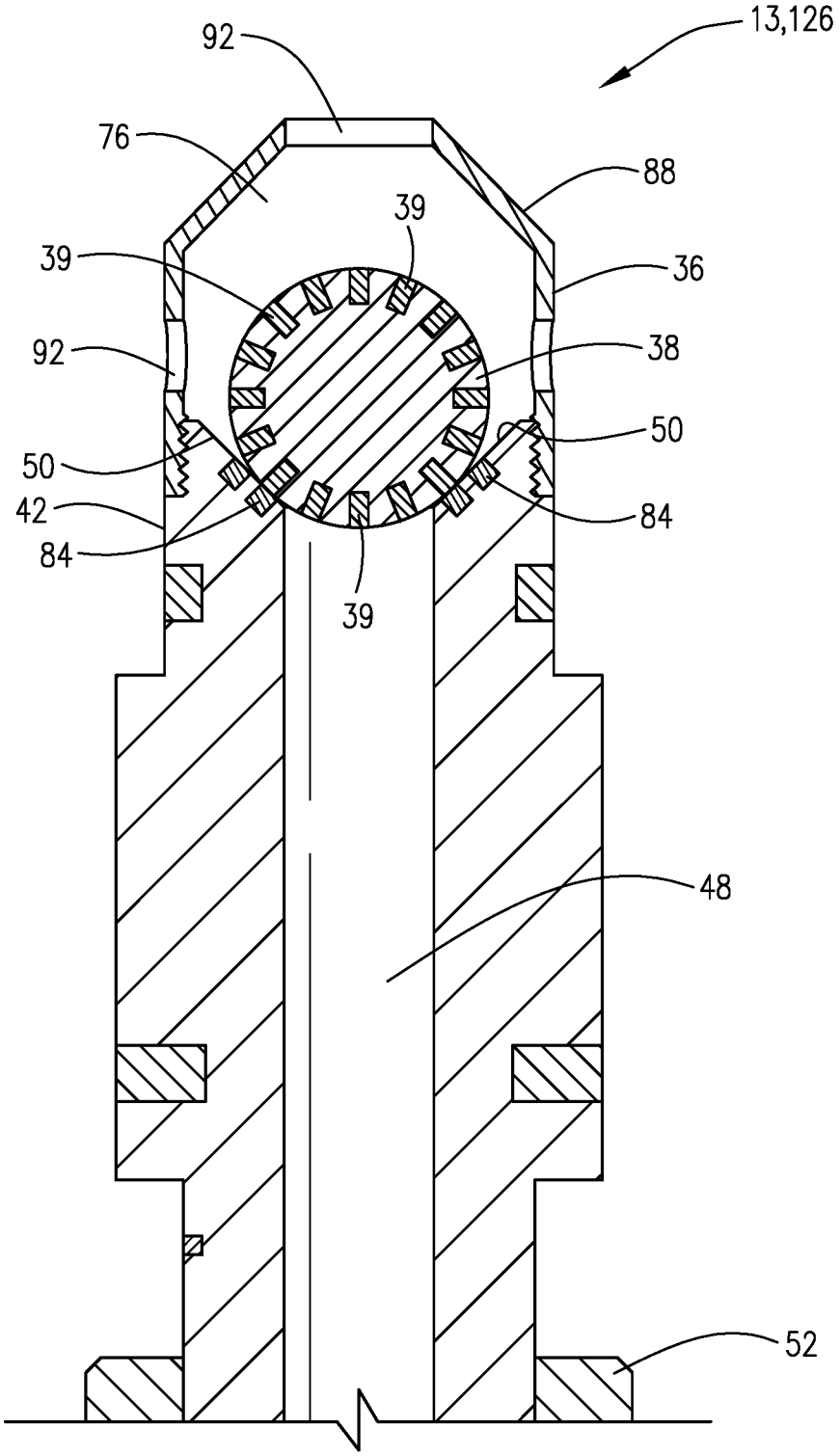

Referring to FIGS. 4 and 5 the upper end 13 of downhole tool 10 can be better seen. FIGS. 4 and 5 are enlargements of the upper end 13 of FIGS. 2 and 3, illustrating the plug 38 in its open position 124 and closed position 126, respectively.

As described above, plug 38 is a magnetic plug having generally the same magnetic polarity across its surface. As illustrated, the magnetic polarity is produced by plug 38 having a plurality of magnetic inserts 39. Plug 38 confined within chamber 76, which is defined by cage 36 and upper end 42 of mandrel 40. Cage or ball cap 36 comprises a body portion 88 having an upper end cap 90 connected thereto, and has a plurality of ports 92 therethrough. The bottom portion of chamber 76 is defined by plug seat 50, which has an aperture 78 having an inner diameter 80 that is less than diameter 37 of plug 38. Further, inner diameter 80 can also be the diameter of longitudinal central flow passage 48. Plug seat 50 is a magnetic seat having generally the same magnetic polarity across its upper surface 82. As illustrated, the magnetic polarity is produced by plug seat 50 having a plurality of magnetic inserts 84. Plug 38 and seat 50 are matching in that plug 38 can sealingly engage plug seat 50 so as to prevent fluid flow through aperture 50 and in that plug 38 and seat 50 have the same magnetic polarity; that is, the outer surface 96 of plug 38 and upper surface 82 of seat 50 either both have a magnetic polarity of north or both have magnetic polarity of south; although, the magnetic intensity can be different. Accordingly, there will be a magnetic resistivity between plug 38 and plug seat 50 by which it is meant that there will be a magnetic repulsion between plug 38 and plug seat 50. Accordingly, plug 38 will not sealingly engage plug seat 50 until this magnetic resistivity is overcome by a predetermined amount of force or pressure on plug 38. FIGS. 3 and 5 illustrate plug 38 in a first position where it is not sealingly engaging seat 50. FIG. 4 illustrates plug 38 in a second position where it sealingly engages seat 50 when a predetermined amount of pressure is applied by a fluid (not shown) flowing downward into cage 36.

The operation of downhole tool 10 is as follows. Downhole tool 10 may be lowered into the wellbore 25 utilizing a setting tool of a type known in the art. As the downhole tool 10 is lowered into the hole, flow therethrough will be allowed since the magnetic resistivity between plug 38 and plug seat 50 will prevent plug 38 from engaging plug seat 50, while cage 36 prevents plug 38 from moving away from plug seat 50 any further than upper end cap 90 will allow. Once downhole tool 10 has been lowered to a desired position in the well 20, a setting tool of a type known in the art can be utilized to move the downhole tool 10 from its unset position 11 to the set position 12 as depicted in FIGS. 2 and 3, respectively. In set position 12, slip segments 56 and expandable packer elements 66 engage casing 30. It may be desirable or necessary in certain circumstances to displace fluid downward through ports 92 in cage 36 and, thus, into and through longitudinal central flow passage 48. For example, once downhole tool 10 has been set it may be desirable to lower another tool into the well, such as a perforating tool, on a wire line. In deviated wells it may be necessary to move the perforating tool to the desired location with fluid flow into the well. If a plug has already been seated and could not easily be removed therefrom, or if a bridge plug was utilized, such fluid flow would not be possible and the perforating or other tool would have to be lowered by other means. The magnetic resistivity allows fluid circulation bypassing plug 38, which is suspended above plug seat 50 by like-pole magnets until a predetermined flow rate or fluid pressure is reached. By increasing the flow rate of the fluid, the drag force on plug 38 increases, which brings plug 38 progressively closer to plug seat 50. As the flow rate increases, at a certain predetermined flow rate, the magnetic forces will be overcome by the drag force imparted on the ball; thus, plug 38 will make contact with plug seat 50, allowing pressure to develop behind plug 38 and extruding plug 38 through plug seat 50 at a predetermined pressure to create a fluid tight seal.

Accordingly, when it is desired to seat plug 38, fluid is displaced into the well at a predetermined flow rate which will overcome the magnetic resistivity. The flow of fluid at the predetermined rate or higher will cause plug 38 to move downwardly such that it engages plug seat 50. When plug 38 is engaged with plug seat 50 and the packer 34 is in its set position 12, fluid flow past downhole tool 10 is prevented. Thus, a slurry or other fluid may be displaced into the well 20 and forced out into a formation above downhole tool 10. The position shown in FIG. 3 may be referred to as a closed position 126 since the longitudinal central flow passage 48 is closed and no flow through downhole tool 10 is permitted. The position shown in FIG. 2 may therefore be referred to as an open position 124 since fluid flow through downhole tool 10 is permitted when the plug 38 has not engaged plug seat 50. As is apparent, plug 38 is trapped in cage 36 and is thus prevented from moving upwardly relative to plug seat 50 past a predetermined distance, which is determined by the length of the cage 36. The magnetic resistivity acts to keep the plug 38 off of plug seat 50 such that flow is permitted until the predetermined flow rate is reached. That is, as explained above, plug 38 will not sealingly engage plug seat 50 until the drag force created by the fluid flow acts on the ball to create at least a predetermined pressure that equals the magnetic resistivity when the plug 38 is sealed against plug seat 50. Cage 36 thus comprises a retaining means for plug 38, and carries plug 38 with and as part of downhole tool 10, and also comprises a means for preventing plug 38 from moving upwardly past a predetermined distance away from plug seat 50.

In one exemplary embodiment in accordance with this disclosure, a check valve comprises a magnetic plug and a magnetic seat. The magnetic plug and magnetic seat operationally engage so as to have a magnetic resistivity such that the magnetic plug has a first position in which it is not sealingly engaged with the magnetic seat and second position where the magnetic plug is sealingly engaged with the magnetic seat. Generally, the magnetic resistivity between the magnetic plug and the magnetic seat retains the magnetic plug in the first position until a predetermined pressure is applied to the magnetic plug, thus, overcoming the magnetic resistivity such that the magnetic plug moves to the second position. The apparatus can be useful in a downhole tool for use in a wellbore.

According to a further embodiment, the magnetic plug is ball plug. The ball plug can have a surface and a plurality of magnetic inserts arranged in a symmetrical pattern about the surface. The symmetrical pattern has icosahedral symmetry. In one example of such embodiment the ball plug has a spherical surface with a plurality of magnetic inserts therein or just under the spherical surface. The magnetic inserts being arranged by dividing the spherical surface into twenty spherical triangles corresponding to the faces of a regular icosahedron. The magnetic inserts are centered at the vertexes of the twenty spherical triangles. The magnetic inserts are aligned such that each magnetic insert has the same magnetic pole facing out from the surface. The magnetic insert can have a circular cross-section, such as by being discs or cylinders.

In another example of such an embodiment, the magnetic inserts are centered at the vertexes and centered within each of the twenty spherical triangles. In a further example of such an embodiment, the icosahedral symmetry is a truncated icosahedral pattern or a soccer ball pattern such that each of the twenty spherical triangles is further divided into nine equilateral triangles and the magnetic inserts are centered at the vertexes of each of the nine equilateral triangles.

In still a further example of such an embodiment, the magnetic inserts are arranged by dividing the twenty triangles into four smaller triangles consisting of a central triangle and three apical triangles by connecting the midpoints of each of the twenty triangles along six great circle paths. The magnetic inserts can be arranged so that the dimples do not intersect the sides of any of the central triangles or the six great circle paths.

In another embodiment, the magnetic plug and magnetic seat comprise part of a downhole tool, which further comprises a mandrel, a cage, an anchor assembly and a sealing element. The mandrel has a central bore defining the magnetic seat. The magnetic seat has magnetic inserts positioned about its surface. The cage is attached to the mandrel and limits longitudinal movement of the magnetic plug. The anchor assembly is disposed about the mandrel and engages the wellbore to anchor the downhole tool in place when the downhole tool is moved from an unset position to a set position. The sealing element is disposed about the mandrel and sealingly engages the wellbore when the downhole tool is in the set position.

In a further embodiment, the cage and the magnetic resistivity retain the magnetic plug in the first position until a predetermined pressure is applied to the magnetic plug, thus, overcoming the magnetic resistivity such that the magnetic plug moves to the second position.

In another exemplary embodiment in accordance with this disclosure, a downhole tool for use in a wellbore comprises a magnetic plug and a magnetic seat. The magnetic plug has a first side and a second side opposing the first side. The magnetic plug is configured such that the first side of the magnetic plug can sealingly engage the magnetic seat when there is a first pressure on the first side and a second pressure on the second side of the magnetic plug and the polarities of the magnetic plug and magnetic seat are configured to prevent such sealing engagement until the second pressure is a predetermined amount greater than the first pressure.

In yet another exemplary embodiment, there is provided a method of using a downhole tool of the type that has a mandrel with an interior surface and an exterior surface, an anchoring assembly disposed about the mandrel and a sealing element disposed about the mandrel, The method comprises:

(a) providing a magnetic plug to the downhole tool under a first pressure wherein the magnetic plug is operationally associated with a magnetic seat defined on the inner surface of the mandrel so as to have a magnetic resistivity such that the magnetic plug is not sealingly engaged with the magnetic seat at the first pressure;

(b) introducing the downhole tool into a wellbore to locate the downhole tool at a desired position;

(c) moving the downhole tool from an unset position to a set position in which the anchoring assembly anchors to the wellbore so as to prevent movement of the downhole tool, and the sealing element seals against the wellbore; and (d) applying a predetermined pressure to the magnetic plug wherein the predetermined pressure is greater than the first pressure such that the magnetic resistivity is overcome so that the magnetic plug is moved into a second position where it sealingly engages the magnetic seat.

In a further embodiment, the method further comprising providing a second pressure to the plug greater than the first pressure and less than the predetermined pressure wherein the magnetic resistivity prevents sealing engagement of the magnetic plug with the magnetic seat at the second pressure.

In still another exemplary embodiment, there is provided a method of using a downhole tool of the type that has a mandrel with an interior surface and an exterior surface, an anchoring assembly disposed about the mandrel and a sealing element disposed about the mandrel. The method comprises:

(a) providing a magnetic plug to the downhole tool such that the magnetic plug is operationally associated with a magnetic seat defined on the inner surface of the mandrel, wherein the magnetic plug has a downhole portion facing the magnetic plug and an uphole portion facing away from the magnetic plug;

(b) introducing the downhole tool into a wellbore to locate the downhole tool at a desired position;

(c) moving the downhole tool from an unset position to a set position in which the anchoring assembly anchors to the wellbore so as to prevent movement of the downhole tool and the sealing element seals against the wellbore;

(d) providing a first fluid pressure uphole from the plug wherein the polarities of the magnetic plug and magnetic seat are configured to prevent sealing engagement of the downhole portion of the plug with the magnetic seat under the first fluid pressure; and (e) providing a second fluid pressure uphole from the plug wherein the polarities of the magnetic plug and magnetic seat are configured to allow sealing engagement of the downhole portion of the magnetic plug with the magnetic seat under the second fluid pressure.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A check valve comprising:

a magnetic plug having an outer surface, wherein said plug has a magnetic polarity which is the same polarity across said outer surface;

a magnetic seat, wherein said magnetic plug and magnetic seat operationally engage so as to have a magnetic resistivity such that said magnetic plug has a first position in which it is not sealingly engaged with said magnetic seat and second position where said magnetic plug is sealingly engaged with said magnetic seat.

2. The check valve of claim 1, wherein said magnetic resistivity between said magnetic plug and said magnetic seat retain said magnetic plug in said first position until a predetermined pressure is applied to said magnetic plug, thus, overcoming said magnetic resistivity such that said magnetic plug moves to said second position.

3. The check valve of claim 1 wherein said magnetic plug is a ball plug.

4. The check valve of claim 3 wherein said ball plug has an outer surface and a plurality of magnetic inserts arranged in a symmetrical pattern about said outer surface of said ball plug.

5. The check valve of claim 4 wherein said symmetrical pattern has icosahedral symmetry.

6. The check valve of claim 1 wherein said check valve comprises part of a downhole tool for use in a wellbore having:

a mandrel having a central bore defining said magnetic seat wherein said magnetic seat has magnetic inserts positioned about its surface;

a cage attached to said mandrel and which limits longitudinal movement of said magnetic plug;

an anchor assembly disposed about said mandrel which engages said wellbore to anchor said downhole tool in place when said downhole tool is moved from an unset position to a set position; and a sealing element disposed about said mandrel which sealingly engages said wellbore when said downhole tool is in said set position.

7. The check valve of claim 6, wherein said cage and said magnetic resistivity retain said magnetic plug in said first position until a predetermined pressure is applied to said magnetic plug, thus, overcoming said magnetic resistivity such that said magnetic plug moves to said second position.

8. The check valve of claim 7 wherein said magnetic plug has an outer surface and a plurality of magnetic inserts arranged in a symmetrical pattern about said outer surface of said magnetic insert.

9. The check valve of claim 8 wherein said symmetrical pattern has icosahedral symmetry.

10. The check valve of claim 1, wherein said magnetic plug is free to rotate in relation to said magnetic seat.

11. The check valve of claim 6, wherein said magnetic plug is free to rotate within said cage.

12. A method of using a downhole tool of the type that has a mandrel with an interior surface and an exterior surface, an anchoring assembly disposed about said mandrel and a sealing element disposed about said mandrel, said method comprising:

(a) providing a magnetic plug to said downhole tool under a first pressure wherein said magnetic plug has an outer surface with a magnetic polarity which is the same polarity across said outer surface, and wherein said magnetic plug is operationally associated with a magnetic seat defined on said inner surface of said mandrel so as to have a magnetic resistivity such that said magnetic plug is not sealingly engaged with said magnetic seat at said first pressure;

(b) introducing said downhole tool into a wellbore to locate said downhole tool at a desired position;

(c) moving said downhole tool from an unset position to a set position in which said anchoring assembly anchors to said wellbore so as to prevent movement of said downhole tool and said sealing element seals against said wellbore; and (d) applying a predetermined pressure to said magnetic plug wherein said predetermined pressure is greater than said first pressure such that said magnetic resistivity is overcome so that said magnetic plug is moved into a second position where it sealingly engages said magnetic seat.

13. The method of claim 12 further comprising providing a second pressure to said plug greater than said first pressure and less than said predetermined pressure wherein said magnetic resistivity prevents sealing engagement of said magnetic plug with said magnetic seat at said second pressure.

14. The method of claim 12 wherein said magnetic plug has an outer surface and a plurality of magnetic inserts positioned about its outer surface.

15. The method of claim 14 wherein said magnetic plug has said magnetic inserts arranged in a symmetrical pattern about said outer surface of said magnetic insert.

16. The method of claim 15 wherein said symmetrical pattern has icosahedral symmetry.

17. The method of claim 12, wherein said magnetic plug is free to rotate with respect to said magnetic seat.

* * * * *